United States Patent [19]

Meeks

[11] 4,060,852

[45] Dec. 6, 1977

[54] STORM CUSHION

[76] Inventor: Dwight S. Meeks, 470 Fairview Road SW., Camden, Ark. 71701

[21] Appl. No.: 650,617

[22] Filed: Jan. 20, 1976

[51] Int. Cl.[2] ..... A41D 15/00

[52] U.S. Cl. ..... 2/84

[58] Field of Search ..... 2/1, 69, 69.5, 84, 85, 2/87, 89, 94, 96, 243 R; 150/52 R, 2.1, 2.2, 2.3, 2.4

[56] References Cited

U.S. PATENT DOCUMENTS

| | | | |
|---|---|---|---|
| 981,738 | 1/1911 | Andrus | 2/84 |
| 2,462,269 | 2/1949 | Krempel | 2/84 |
| 2,971,198 | 2/1961 | Tomich | 2/84 |
| 3,228,034 | 1/1966 | Grove | 2/69.5 |
| 3,835,471 | 9/1974 | Lankford | 2/84 |

*Primary Examiner*—Werner H. Schroeder
*Assistant Examiner*—Moshe I. Cohen
*Attorney, Agent, or Firm*—John M. Harrison

[57] ABSTRACT

A storm cushion having an attached stylish or protective foul or cold weather garment in the interior thereof which can be used in conventional manner as a cushion and can also be unfolded from the interior of the cushion and used in bad or cold weather with the cushion still in position and functioning as a seating pad.

8 Claims, 5 Drawing Figures

STORM CUSHION

BACKGROUND OF THE INVENTION

1. Field of the Invention

This invention relates to a stylish or protective garment, including a foul or cold weather garment, and more particularly, to a protective garment which is attached to a seat cushion and which is capable of being folded into the cushion when not in use. The protective garment is designed to protect the wearer from rain, sleet, snow, wind, and cold, and may be interiorly lined and fitted with a hood, as desired. When removed from the cushion, the garment can be worn as any conventional stylish, foul or cold weather garment with the cushion attached in the rear to function as a pad when the wearer is seated. The protective garment may be typically zipped, snapped or otherwise fastened into the interior of the cushion with appropriate closures to form a pad for seating during such activities as picnics, boating, good weather viewing of football or baseball games or other outdoor use.

2. Description of the Prior Art

Heretofore, foul weather and other protective garments such as slicker suits, rain parkas and ponchos have been typically carried in a small plastic container or rolled into a tight bundle when not in use. Typical of such prior art disclosures is the convertible cushion disclosed in U.S. Pat. No. 2,462,269 to A. W. Krempel which illustrates the use of a foul weather rain cape having a hood which also serves as a carrier for the cape. The cape is folded into the interior of the hood when not in use.

Similarly, U.S. Pat. No. 2,971,198 to M. M. Tomich discloses a rain cape having a hood which serves to receive the folded cape when the latter is not in use. The folded hood is zipped to form a convenient carrying bag after the cape is tucked inside.

Accordingly, it is an object of this invention to provide a storm cushion which is designed to carry a stylish, cold or foul weather garment or alternative protective garment, and which is designed to remain attached to the rear of the garment when the garment is removed and worn to function as a cushion for seating purposes while the garment is in use.

Another object of the invention is to provide a combination seat cushion and attached stylish or protective foul or cold weather garment, the latter of which can be alternatively folded into the cushion and unfolded and slipped on, as desired, with the cushion remaining attached to the garment at all times.

Yet another object of the invention is to provide a seat cushion and stylish or protective garment combination, which garment can be removably attached to the interior of the cushion and used either with the cushion in place or without the cushion, as desired.

A still further object of the invention is to provide a combination cushion and attached stylish or protective foul or cold weather garment, which garment can be manufactured of thin plastic as a rain repellant covering, or of heavier materials as a cold weather coat or poncho, and which may be equipped with a hood if desired.

SUMMARY OF THE INVENTION

These and other objects of the invention are provided in a storm cushion having an attached stylish, foul or cold weather protective garment which can be folded into the interior of the cushion and the cushion used in conventional fashion, or removed from the cushion interior and worn either with the cushion in place or removed, as desired.

BRIEF DESCRIPTION OF THE DRAWING

The invention will be better understood in view of the following description presented with reference to the accompanying drawing.

DESCRIPTION OF THE PREFERRED EMBODIMENTS

Figure 1:
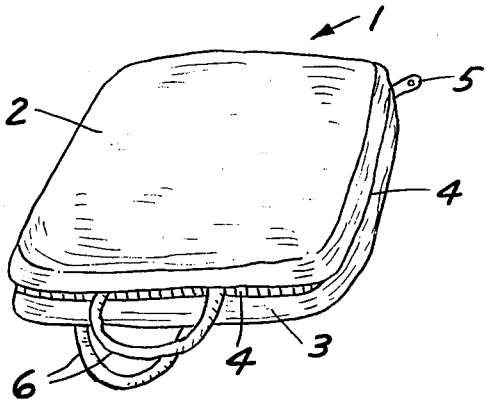
FIG. 1 of the drawing is a perspective view of the storm cushion of this invention with a stylish, foul or cold weather garment zipped inside.

Referring to FIG. 1 of the drawing, the storm cushion of this invention, generally illustrated by reference numeral 1 is shown, with cover 2 and bottom 3, connected by zipper 4, which is operated by zipper pull 5. Handles 6, attached to cover 2 and bottom 3, respectively, serve to provide a convenient means for carrying storm cushion 1.

Figure 2:
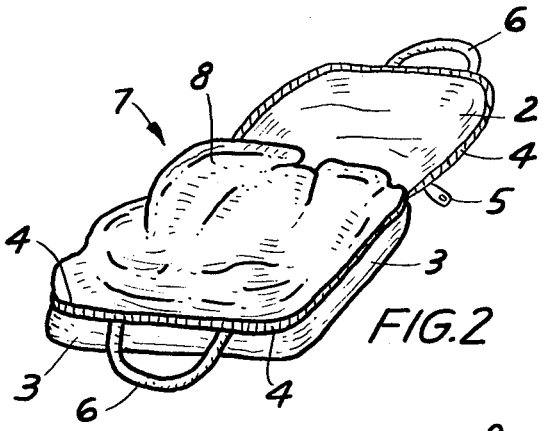
FIG. 2 is a perspective view of the storm cushion illustrated in FIG. 1 with the cover of the cushion unzipped and folded away from the bottom portion and exposing the garment folded inside the cushion.
Figure 3:
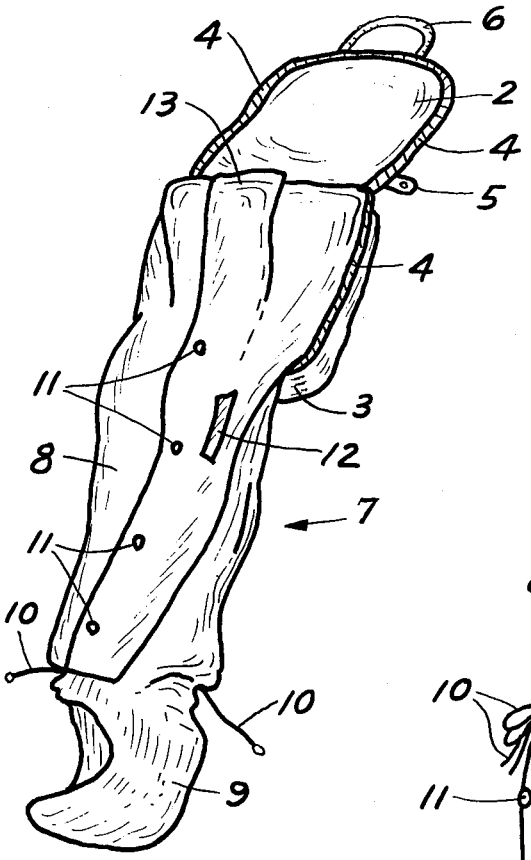
FIG. 3 is a perspective view of the storm cushion and garment illustrated in FIGS. 1 and 2, more particularly showing the outfolding of the attached garment from the interior of the cushion.

Referring now to FIGS. 2 and 3 of the drawing, when zipper pull 5 is manipulated around zipper 4 to separate cover 2 and bottom 3, and cover 2 is folded rearwardly as illustrated, protective garment 7 is exposed and can be unfolded as shown in FIG. 3. Protective garment 7 is typically formed of a body portion 8 and a hood 9, which may be typically of poncho or slicker design, and which may be equipped with draw strings 10 to fit hood 9 tightly around the neck of the wearer. Optional closures 11, typically snaps, buttons or a zipper, serve to permit donning of protective garment 7 and closures of body portion 8 around the torso of a wearer. Arm slots 12 are provided for extension of the wearer's arms, and in the alternative, protective garment 7 may be equipped with sleeves.

Figure 4:
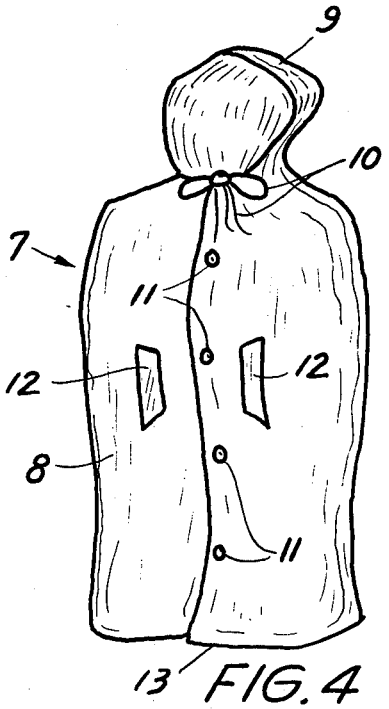
FIG. 4 is a front perspective view of the garment fully unfolded and extended from the interior of the cushion and in wearing configuration.
Figure 5:
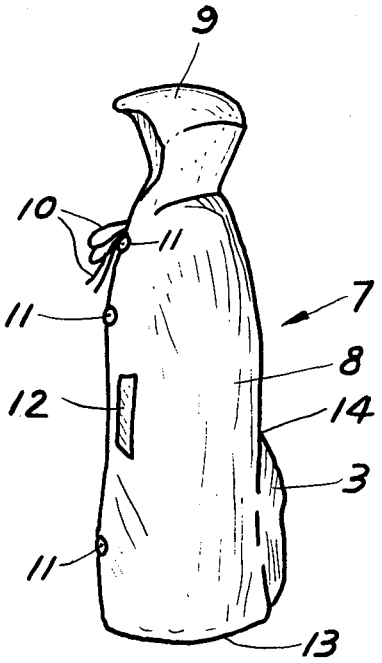
FIG. 5 is a side perspective view of the fully extended garment illustrated in FIG. 4 of the drawing, more particularly illustrating a preferred attachment of the cushion to the garment in posterior position for use as a seating pad.

Referring to FIGS. 4 and 5 of the drawing, protective garment 7 is illustrated in fully extended configuration, more particularly showing the optional protective feature of a hood 9 and cooperating draw strings 10. As illustrated in FIG. 5, bottom 3 of storm cushion 1 is carried by the posterior section of body portion 8 in order to provide a built-in cushioning function when the wearer is seated. Bottom 3 of storm cushion 1 typically contains a foam rubber pad (not illustrated) which provides the cushioning element when protective garment 7 is unfolded from the interior of storm cushion 1 and is in use.

It will be appreciated that when protective garment 7 is folded into the interior of storm cushion 1 in the configuration illustrated in FIG. 1 of the drawing it also serves to provide a cushioning effect in storm cushion 1 when storm cushion 1 is used in conventional fashion. Furthermore, zipper 4 and zipper pull 5 may be replaced with alternative closure means such as loop pile fasteners, buttons and snaps as desired. It will also be appreciated that protective garment 7 may be formed of substantially any appropriate material, including thin plastic, to provide a rain, sleet and snow protective function, or in the alternative, a heavier, lined material may be used to provide an additional cold weather protection. Furthermore, protective garment 7 can be sewn into bottom 3 along bottom edge 13 and top juncture 14, of body 8, or in the alternative, it can be zipped, buttoned, snapped or fastened with loop pile binders into bottom 3 to permit removal of bottom 3 from body portion 8 and use of protective garment 7 in conventional fashion without a padding function.

Referring again to FIG. 5 of the drawing, it will be appreciated that cover 2 of storm cushion 1 can be folded under bottom edge 13 of body portion 8 and buttoned, snapped, zipped, or otherwise removably secured to the underside of body portion 8, as desired, in order to conveniently locate cover 2 while protective garment 7 is being worn.

Having described my invention with the particularity set forth above what is claimed is:

1. A storm cushion comprising:

a padded cushion having a top portion or cover and a bottom portion joined to said cover along a first edge of said cushion;

b. a one piece protective garment disposed inside said cushion between said cover and said bottom portion and attached to said bottom portion on all four sides of said bottom portion with said first edge attached to and coextensive with the rear bottom edge of said protective garment to form a padded seat for said protective garment; and c. closure means carried by said cover and said bottom portion of said cushion to releasably secure said protective garment inside cushion.

2. The storm cushion of claim 1 wherein said closure means is a zipper.

3. The storm cushion of claim 1 wherein said protective garment is removably attached to said bottom portion.

4. The storm cushion of claim 1 wherein:

a. said closure means is a zipper; and b. said protective garment is removably attached to said bottom portion.

5. The storm cushion of claim 1 wherein said protective garment is fitted with a hood, arm openings and closures.

6. The storm cushion of claim 1 wherein:

a. said closure means is a zipper;

b. said protective garment is removably attached to said bottom portion; and c. said protective garment is fitted with a hood, arm openings and closures.

7. The storm cushion of claim 1 wherein said protective garment is fitted with closures on the inside thereof to receive and secure cooperating closures on said cover when said protective garment has been removed from said storm cushion and is in wearing configuration and said cover has been reverse folded along said first edge and further comprising handle means carried by said cover and said bottom portion on a second edge edge of said cushion opposite said first edge.

8. The storm cushion of claim 1 wherein:

a. said closure means is a zipper;

b. said protective garment is removably attached to said bottom portion;

c. said protective garment is fitted with a hood, arm openings and closures; and d. said protective garment is fitted with closures on the inside thereof to receive and secure cooperating closures on said cover when said protective garment has been removed from said storm cushion and is in wearing configuration and said cover has been reverse folded along said first edge, and further comprising handle means carried by said cover and said bottom portion on a second edge of said cushion opposite said first edge.

* * * * *